US009181936B2

(12) United States Patent
Nomura et al.

(10) Patent No.: US 9,181,936 B2
(45) Date of Patent: Nov. 10, 2015

(54) SWASH PLATE COMPRESSOR

(75) Inventors: Satoshi Nomura, Toyota (JP); Masaharu Hatta, Toyota (JP); Masanori Akizuki, Toyota (JP)

(73) Assignee: TAIHO KOGYO CO., LTD., Toyota-shi, Aichi (JP)

( * ) Notice: Subject to any disclaimer, the term of this patent is extended or adjusted under 35 U.S.C. 154(b) by 455 days.

(21) Appl. No.: 13/703,743

(22) PCT Filed: Mar. 22, 2011

(86) PCT No.: PCT/JP2011/056730

§ 371 (c)(1),
(2), (4) Date: Dec. 12, 2012

(87) PCT Pub. No.: WO2012/014523

PCT Pub. Date: Feb. 2, 2012

(65) Prior Publication Data

US 2013/0084195 A1 Apr. 4, 2013

(30) Foreign Application Priority Data

Jul. 28, 2010 (JP) ..... 168799/2010

(51) Int. Cl.
*F04B 27/08* (2006.01)

(52) U.S. Cl.
CPC ..... *F04B 27/0821* (2013.01); *F04B 27/0886* (2013.01)

(58) Field of Classification Search
CPC ..... F04B 27/0821; F04B 27/0886; F04B 27/0882; F04B 27/0878
See application file for complete search history.

(56) References Cited

U.S. PATENT DOCUMENTS 4,732,047 A * 3/1988 Kato et al. ..... 74/60
5,483,867 A * 1/1996 Ikeda et al. ..... 92/71
5,896,803 A * 4/1999 Sugawara et al. ..... 92/12.2

(Continued)

FOREIGN PATENT DOCUMENTS

JP 3259777 6/2001
JP 2004-84574 3/2004

(Continued)

OTHER PUBLICATIONS

Takasaki Hideyuki, JP2007-278149 Machine Translation, Espacenet, Oct. 2007.*

(Continued)

*Primary Examiner* — Nathaniel Wiehe
*Assistant Examiner* — Dustin T Nguyen
(74) *Attorney, Agent, or Firm* — Flynn, Thiel, Boutell & Tanis, P.C.

(57) ABSTRACT

A swash plate compressor 1 includes a swash plate 3 which rotates around a rotary shaft 2, a piston 4 which moves forward and backward in response to the rotation of the swash plate 3 and in which a hemispherical concave sliding surface 4*a* is formed, and a shoe 5 in which there are formed a flat end surface portion 12 which comes into sliding contact with the swash plate 3 and a spherical surface portion 11 which comes into sliding contact with the sliding surface 4*a* of the piston 4. A columnar portion 13 is formed between the spherical surface portion 11 and the end surface portion 12 in the shoe 5, and in a boundary area between the columnar portion 13 and the spherical surface portion 11, there is formed a spherical-surface-portion side flange 14 which protrudes radially outward and constitutes the spherical surface portion.

7 Claims, 3 Drawing Sheets

(56) References Cited

U.S. PATENT DOCUMENTS

| | | | | |
|---|---|---|---|---|
| 6,477,938 | B1 * | 11/2002 | Nakayama et al. | 92/71 |
| 2007/0272076 | A1 * | 11/2007 | Bin et al. | 92/71 |
| 2009/0205754 | A1 * | 8/2009 | Kanemitsu et al. | 148/500 |

FOREIGN PATENT DOCUMENTS

| | | | | |
|---|---|---|---|---|
| JP | 2006-161801 | | 6/2006 | |
| JP | 2006-183627 | | 7/2006 | |
| JP | 2007-278149 | * | 10/2007 | F04B 27/08 |
| JP | 2008-69747 | | 3/2008 | |
| WO | WO 02/075172 A1 | | 9/2002 | |

OTHER PUBLICATIONS

Form PCT/ISA/210 dated Jun. 14, 2011 (3 pages).
Form PCT/ISA/220 dated Jun. 14, 2011 (4 pages).
Form PCT/ISA/237 dated Jun. 14, 2011 (4 pages).

* cited by examiner

SWASH PLATE COMPRESSOR

TECHNICAL FIELD

The present invention relates to a swash plate compressor and, more particularly, to a swash plate compressor provided with a swash plate which rotates around a rotary shaft, a piston which moves forward and backward in response to the rotation of the swash plate, and a shoe in which there are formed an end surface portion which comes into sliding contact with the above-described swash plate and a spherical surface portion which comes into sliding contact with a hemispherical concave sliding surface formed in the above-described piston.

BACKGROUND ART

There has hitherto been known a swash plate compressor which is provided with a swash plate which rotates around a rotary shaft, a piston which moves forward and backward in response to the rotation of the swash plate and in which a hemispherical concave sliding surface is formed, and a shoe in which there are formed a flat end surface portion which comes into sliding contact with the above-described swash plate and a spherical surface portion which comes into sliding contact with the above-described sliding surface formed in the above-described piston (Patent Literature 1 and Patent Literature 2).

In the swash plate compressor of Patent Literature 1, in order to ensure the lubrication of a sliding surface of the above-described piston and a spherical surface portion of the shoe, the surface roughness of a non-sliding portion in the spherical surface portion of the shoe which does not come into sliding contact with the above-described sliding surface is made large, whereby a lubricating oil is held in the non-sliding contact part.

In the swash plate compressor of Patent Literature 2, the weight of a shoe is reduced by making the shoe hollow and the inertial force to the shoe caused by the reciprocating motion of a piston is reduced, whereby the sliding performance between the sliding surface of the piston and the spherical surface portion of the shoe is improved.

PRIOR ART DOCUMENTS

Patent Literature

Patent Literature 1: Registered Patent Publication No. 3259777

Patent Literature 2: Japanese Patent Laid-Open No. 2008-069747

SUMMARY OF INVENTION

Problems to be Solved by the Invention

However, in the case of the swash plate compressors of Patent Literature 1 and Patent Literature 2, the shoe oscillates during the reciprocating motion of the piston and a space is formed between the sliding surface of the above-described piston and the spherical surface portion of the shoe. This space is not configured to positively cause a lubricating oil to flow in because of its minute size. Furthermore, in the case where foreign matter floats in the lubricating oil, the foreign matter enters the above-described space, posing the problem that the piston and the shoe are damaged thereby.

In view of these problems, the present invention provides a swash plate compressor which can perform the lubrication of the above-described shoe satisfactorily and in which the foreign matter in the lubricating oil is less apt to enter the sliding parts.

Means for Solving the Problems

That is, a swash plate compressor according to the invention comprises: a swash plate which rotates around a rotary shaft; a piston which moves forward and backward in response to the rotation of the swash plate and in which a hemispherical concave sliding surface is formed; and a shoe in which there are formed a flat end surface portion which comes into sliding contact with the swash plate and a spherical surface portion which comes into sliding contact with the sliding surface of the piston. In this swash plate compressor, a columnar portion is formed between the spherical surface portion and the end surface portion in the shoe, and in a boundary area between the columnar portion and the spherical surface portion, there is formed a spherical-surface-portion side flange which protrudes radially outward and constitutes the spherical surface portion.

Advantageous Effects of Invention

According to the above-described invention, forming the spherical-surface-portion side flange enables a lubricating oil to be accommodated in a concavity formed in the boundary area between the spherical-surface-portion side flange and the columnar portion, and it is possible to cause the spherical surface portion and the sliding surface of the piston to slide satisfactorily using a lubricating oil overflowing the above-described concavity.

In addition, when foreign matter in the lubricating oil is accommodated in the above-described concavity, the foreign matter cannot go beyond the above-described spherical-surface-portion side flange due to the surface tension of the lubricating oil and it is ensured that the foreign matter does not enter between the spherical surface portion and the sliding surface.

MODE FOR CARRYING OUT THE INVENTION

Figure 1:
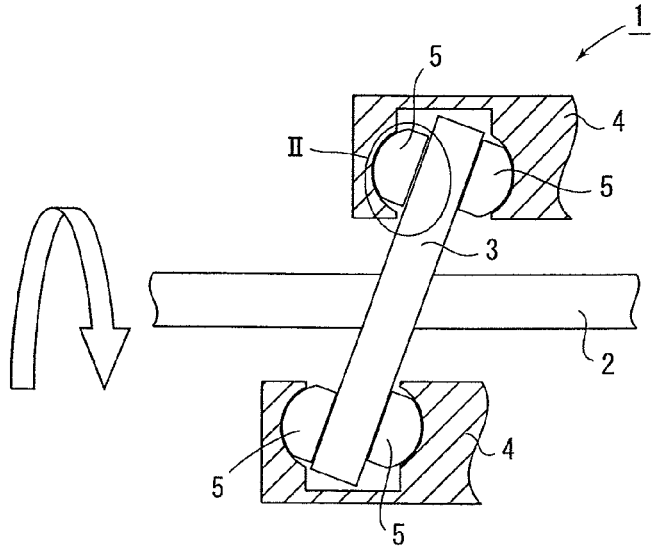
FIG. 1 is a sectional view of a swash plate compressor.

The embodiments will be described below. FIG. 1 shows the internal configuration of a swash plate compressor 1, and shows a rotary shaft 2 pivotally supported by a housing, which is not shown, a swash plate 3 attached to the rotary shaft 2, a plurality of pistons 4 which move forward and backward in cylinder bores (not shown) of the housing, a plurality of shoes which are provided in such a manner as to be opposed to the interior of each piston 4 and support the above-described swash plate 3 in a sandwiching manner.

The above-described swash plate 3 is fixed obliquely with respect to the rotary shaft 2 or is adapted to change the inclination angle of the swash plate 3, and is sandwiched by two shoes 5 for each piston 4. An area of the swash plate 3, which comes into sliding contact with the above-described shoe 5, is coated with a desired thermal-sprayed layer, a coating layer, a resin coating and the like.

The configuration of the swash plate 3 capable of being used in the present invention is not limited to the foregoing. It is possible to use various conventional publicly-known swash plates 3.

A hemispherical concave sliding surface 4*a* is formed on the above-described piston 4 in such a manner as to face each other, and the above-described shoe 5 is adapted to convert the rotation of the above-described swash plate 3 to a forward and backward motion of the piston 4 while oscillating with respect to this sliding surface 4*a*.

The above-described shoe 5 can be made from sintered materials, resin materials and the like in addition to ferrous materials, copper-based materials, and aluminum-based materials, and is preferably manufactured by the forging and rolling of SUJ2.

The swash plate compressor 1 having this configuration has hitherto been publicly known and a more detailed description is omitted.

Figure 2:
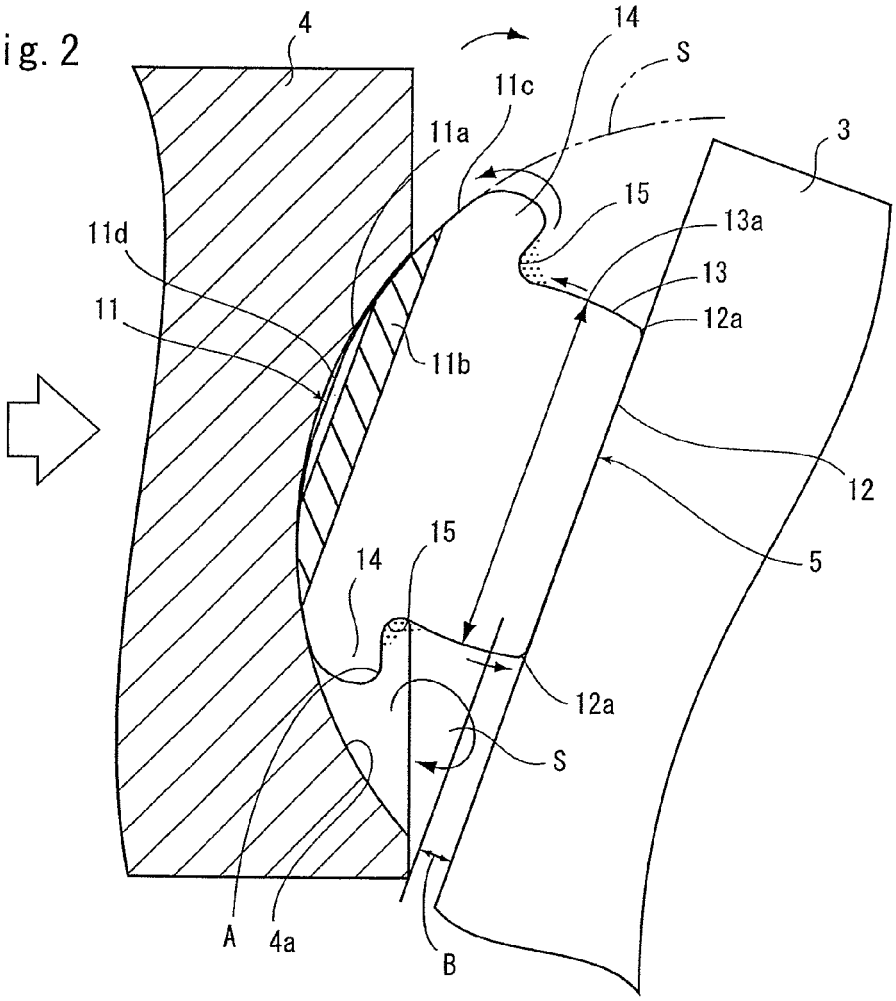
FIG. 2 is an enlarged sectional view of a shoe in the first embodiment.

FIG. 2 shows an enlarged sectional view of part II in FIG. 1. The above-described shoe 5 has a spherical surface portion 11 which comes into sliding contact with the sliding surface 4*a* of the above-described piston 4, an end surface portion 12 which comes into sliding contact with the swash plate 3, and a columnar portion 13 formed between the above-described spherical surface portion 11 and the end surface portion 12.

In the above-described spherical surface portion 11, there is formed a spherical-surface-portion side flange 14 which protrudes radially outward from the boundary portion between the spherical surface portion 11 itself and the above-described columnar portion 13. The spherical-surface-portion side flange 14 is smoothly connected to the above-described spherical surface portion 11 and has the same radius of curvature, thereby constituting part of the above-described spherical surface portion 11.

In the spherical surface portion 11 including the above-described spherical-surface-portion side flange 14, there are formed an inner side draft portion 11*a*, which is formed at the top and does not come into contact with the sliding surface 4*a* of the piston 4, a sliding contact portion 11*b* which surrounds the inner side draft portion 11*a* and comes into sliding contact with the above-described sliding surface 4*a*, which is hatched in the figure, and an outer side draft portion 11*c* which surrounds the sliding contact portion 11*b* and is positioned at an outer periphery of the above-described spherical-surface-portion side flange 14.

For the above-described inner side draft portion 11*a* and outer side draft portion 11*c*, the surface roughness is made rougher than in the above-described sliding contact portion 11*b* so that a lubricating oil is held on the surface.

Furthermore, a flat surface 11*d* is formed in the middle of the above-described inner side draft portion 11*a* and a space is formed by the flat surface 11*d* and the sliding surface 4*a* of the above-described piston 4, whereby a lubricating oil is accommodated in the space.

For the above-described spherical-surface-portion side flange 14, as shown in FIG. 2, when the inclination of the shoe 5 becomes a maximum, an end portion A of the spherical-surface-portion side flange 14 on the swash plate 3 side is set in such a manner as not to protrude to the swash plate 3 side beyond the height B of a portion nearest to the swash plate in the above-described piston 4.

The sliding contact surface of the above-described end surface portion 12 in contact with the above-described swash plate 3 is such that the middle thereof is swollen a little to the swash plate 3 side, as a result of which it is ensured that a lubricating oil is drawn to between the end surface portion 12 and the swash plate 3.

A micro corrugated shape is formed by laser processing and the like on the sliding contact surface of the end surface portion 12 in contact with the above-described swash plate 3, whereby an improvement in the performance of sliding with the swash plate 3 is achieved.

As an example of this micro corrugated shape, micro circles are drawn on the surface of the above-described end surface portion 12 by laser light and thereafter the surface of the end surface portion 12 is subjected to lapping and buffing, whereby it is possible to form an annular micro corrugated shape on the surface of the end surface portion 12. This annular micro corrugated shape is formed on the whole surface area of the end surface portion 12 in zigzag patterns and lengthwise and crosswise at regular intervals. This micro corrugated shape is not limited to the above-described annular shape and may be other shapes, such as longitudinal lines and a check of longitudinal and lateral lines, and lines of concentric circles.

Furthermore, a draft portion 12*a* which does not come into sliding contact with the swash plate 3 is formed at the outer periphery of the end surface portion 12.

Next, in an intermediate area of the columnar portion 13 between the spherical surface portion 11 and the end surface portion 12, there is formed a swollen portion 13*a* whose outer circumferential surface is swollen radially outward, and this swollen portion 13*a* has a diameter smaller than the outside diameter of the above-described spherical-surface-portion side flange 14.

The surface roughness of the columnar portion 13 is rougher than the surface roughness of the sliding contact portion 11*b* of the above-described spherical surface portion 11 so that the columnar portion 13 is configured to easily hold a lubricating oil on the surface thereof as with the above-described inner side draft portion 11*a* and outer side draft portion 11*c*.

In the boundary are between the columnar portion 13 and the above-described spherical-surface-portion side flange 14, a concavity is formed radially inward, and in this embodiment, this concavity is shaped to provide a constricted portion 15 which is recessed toward the above-described piston 4 rather than to an outer peripheral edge of the spherical-surface-portion side flange 14.

It is preferred that the height of the above-described columnar portion 13, i.e., the height from a portion in sliding contact with the above-described swash plate 3 to the base of the spherical-surface-portion side flange 14, be set larger than 1:1 with respect to the height from the end portion A of the spherical-surface-portion side flange 14 of the above-described spherical surface portion 11 on the spherical surface side to the top of the spherical surface portion 11.

This setting enables a large amount of lubricating oil to be supplied to a space s formed by the sliding surface 4*a*, the shoe 5, and the swash plate 3, which is described below.

According to the swash plate compressor 1 having this configuration, by rotation of the above-described swash plate 3, the above-described shoe 5 is adapted to slide along the sliding surface 4*a* of the piston 4 while being inclined according to the angle of the swash plate 3 and convert the rotation of the swash plate 3 to a reciprocating motion of the piston 4.

When the shoe 5 oscillates and the flange 14 approaches the sliding surface 4*a*, as shown in the lower part of FIG. 2, the space s is formed by the sliding surface 4*a*, the shoe 5, and the swash plate 3.

This space s is positioned on the inner side of an imaginary spherical surface S (indicated by an alternate long and two short dashes line in the figure), which is obtained by extending the above-described sliding surface 4*a* as it is, and in the shoe 5 of this embodiment, the volume thereof can be reduced by the amount corresponding to the above-described space s compared to a conventional hemispherical shoe, with the result that the shoe 5 of this embodiment can be reduced in weight compared to a conventional shoe 5.

Because this weight reduction enables the striking load caused by the reciprocating motion of the piston 4 to be reduced, it is possible to prevent the wear of the coating of the above-described swash plate 3 as far as possible and hence it becomes possible to prevent the posture of the shoe 5 from becoming unstable due to an increase in the clearance between the shoe 5 and the swash plate 3.

In some cases, it becomes possible to reduce the cost of the swash plate 3 by omitting the whole or part of the coating. Specifically, it is possible to use swash plates 3 as described in International Publication No. WO/2002/075172 and Japanese Patent Laid-Open No. 2006-161801.

Furthermore, in the above-described spherical-surface-portion side flange 14 formed in the boundary area between the spherical surface portion 11 of the shoe 5 and the columnar portion 13, the base thereof is adapted to be elastically deformed by the vibration caused by the above-described striking load, and it is possible to lessen the biting of the shoe 5 into the piston 4 when the piston oscillates within the sliding surface 4*a* of the piston 4.

The end portion A of the above-described spherical-surface-portion side flange 14 on the swash plate 3 side is set in such a manner as not to protrude to the swash plate 3 side beyond the height B from the swash plate 3 of the above-described piston 4, whereby a lubricating oil which has come to the mist state is supplied to the sliding portion of the spherical surface portion 11 and the sliding surface 4*a* of the piston 4 without being hindered by the spherical-surface-portion side flange 14.

Next, a description will be given of the movement of a lubricating oil and a cooling medium flowing in the interior of the swash plate compressor 1. Here, the description is given on the assumption that in FIG. 2 the above-described piston 4 moves from left to right as shown in the figure and as a result of this, the above-described shoe 5 is in the state in which the shoe 5 is inclined at a maximum angle while rotating clockwise as shown in the figure.

First, because the above-described columnar portion 13 is shaped to provide a surface roughness of the outer peripheral surface thereof to be rougher than the surface roughness of the above-described sliding surface 4*a* and the sliding contact portion 11*b* of the spherical surface portion 11, the lubricating oil tends to remain on the surface of this columnar portion 13.

Next, in the case where the shoe 5 rotates clockwise as shown in the figure, in the upper part of the shoe 5 shown in the figure, the lubricating oil and cooling medium adhering to the outer peripheral surface of the above-described columnar portion 13 tends to flow from right to left as shown in the figure due to the inertial force by the rotation of the shoe 5 and the resistance by the atmosphere in the swash plate compressor 1.

Here, because the above-described swollen portion 13*a* is formed in the above-described columnar portion 13, the lubricating oil present nearer to the above-described spherical surface portion 11 side than to the swollen portion 13*a* side tends to flow to the spherical surface portion 11 side.

As a result, although the lubricating oil is accommodated in the constricted portion 15 formed in the boundary area between the above-described spherical-surface-portion side flange 14 and the above-described columnar portion 13, thereafter this lubricating oil overflows the constricted portion 15 to the spherical surface portion 11 side, flows along the spherical-surface-portion side flange 14, and then flows between the spherical surface portion 11 and the sliding surface 4*a* of the piston 4, lubricating these portions.

On the other hand, although the foreign matter in the lubricating oil is accommodated in the constricted portion 15 together with the lubricating oil, due to the surface tension of the lubricating oil and cooling medium accommodated in the constricted portion 15, the foreign matter cannot flow beyond the above-described spherical-surface-portion side flange 14 and it is ensured that the foreign matter is prevented from entering between the shoe 5 and the piston 4.

Figure 5:
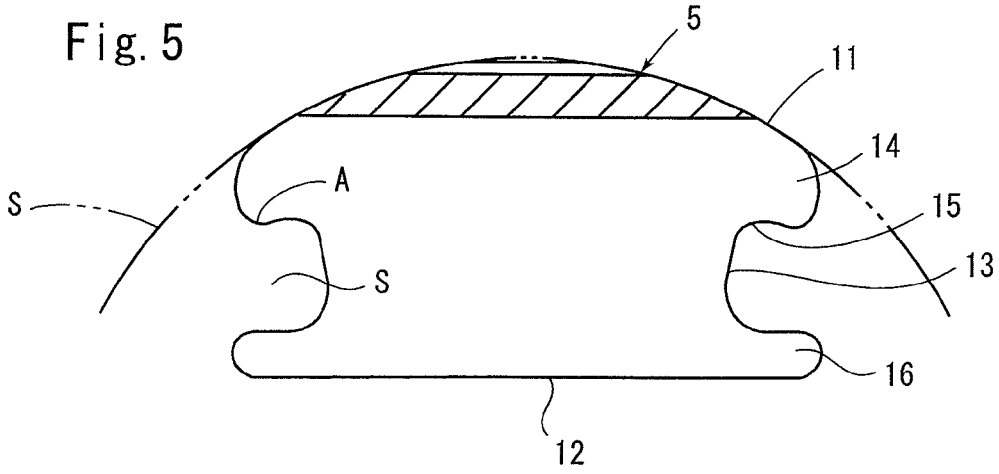
FIG. 5 is an enlarged sectional view of a shoe in the fourth embodiment.

Next, on the lower side of the shoe as shown in FIG. 5, when the lubricating oil and the cooling medium flow into the space s formed by the above-described sliding surface 4*a*, the columnar portion 13, and the spherical-surface-portion side flange 14, due to the surface roughness of the above-described columnar portion 13, the lubricating oil which has flown into this space s tends to remain on the surface of this columnar portion 13.

On the other hand, because the shoe 5 rotates clockwise as shown in the figure, the lubricating oil and cooling medium adhering to the outer circumferential surface of the columnar portion 13 flows from left to right as shown in the figure due to the inertial force by the rotation of the shoe 5 and the resistance by the atmosphere in the swash plate compressor 1 and in the above-described space s, clockwise convention occurs as shown in the figure due to the lubricating oil and the cooling medium.

Because the swollen portion 13*a* is formed in the above-described columnar portion 13, the lubricating oil present nearer to the end surface 12 side than to the swollen portion 13*a* side flows along the columnar portion 13 due to the above-described inertial force, and then flows between the above-described end surface portion 12 and the swash plate 3, lubricating these portions.

On the other hand, the foreign matter in the lubricating oil accommodated in the above-described constricted portion 15 cannot go beyond the above-described swollen portion 13*a* due to the surface tension and it is ensured that the foreign matter is prevented from entering between the shoe 5 and the swash plate 3.

According to the above-described embodiment, forming the columnar portion 13 on the above-described shoe 5 enables the shoe 5 to be reduced in weight compared to the conventional shoe 5 by an amount corresponding to the volume s of the above-described space, and it is possible to prevent the wear of the swash plate 3 due to the striking load and an expansion of the shoe 5 clearance as far as possible.

A concavity is formed in the boundary area between the columnar portion 13 and the spherical-surface-portion side flange 14 and this concavity is formed as the above-described constricted portion 15, whereby a lubricating oil is accommodated in a volume larger than before and at the same time foreign matter can be accommodated in a volume larger than before.

Furthermore, the above-described swollen portion 13*a* is formed in the intermediate area of the above-described columnar portion 13, whereby a lubricating oil is accommodated in the above-described constricted portion 15 in volumes larger than before and at the same time foreign matter can be accommodated in a volume larger than before.

FIGS. 3 to 6 show the second to fifth embodiments, respectively, of the present invention. In the following description, the same component elements as in the first embodiment bear the same reference signs as the relevant component elements, and detailed descriptions of such component elements are omitted.

Figure 3:
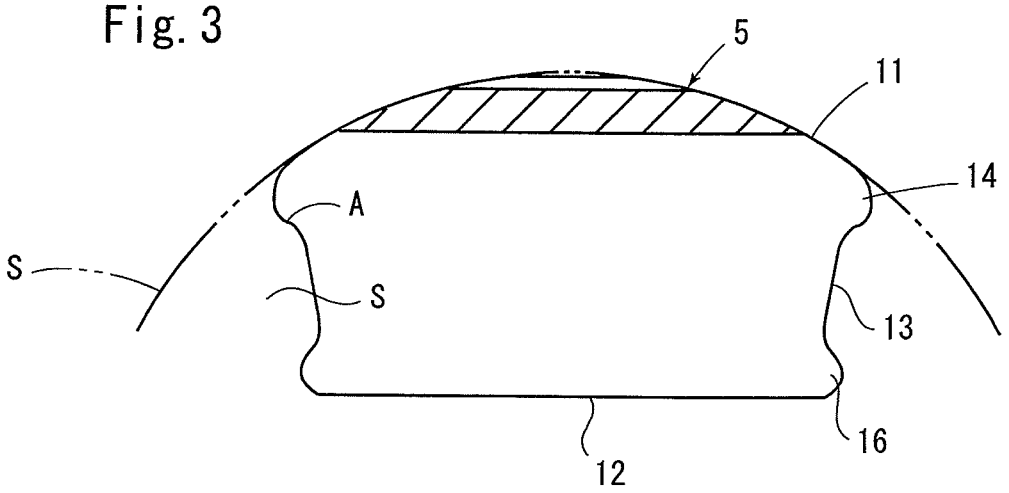
FIG. 3 is an enlarged sectional view of a shoe in the second embodiment.

The shoe 5 of the second embodiment shown in FIG. 3 is configured in such a manner that a spherical-surface-portion side flange 14 is provided in the boundary area between the above-described columnar portion 13 and the spherical surface portion 11 and an end-surface-portion side flange 16 which protrudes radially outward is provided in the boundary area between the columnar portion 13 and the end surface portion 12.

The above-described columnar portion 13 is formed in such a manner that the diameter of the boundary area between the columnar portion 13 itself and the above-described spherical portion 13 is formed to provide a larger diameter than the diameter of the boundary area between the columnar portion 13 itself and the above-described end surface portion 12, and the columnar portion 13 has a taper having a diameter which decreases from the spherical surface portion 11 toward the end surface portion 12. The adoption of this configuration enables a weight reduction to be achieved by increasing the volume of the space s formed by the above-described piston 4, the swash plate 3, and the shoe 5.

On the other hand, in the shoe 5 of this embodiment, unlike the shoe 5 of the first embodiment, the above-described constricted portion 15 is not formed in the boundary area between the columnar portion 13 and the spherical-surface-portion side flange 14, nor is formed the above-described swollen portion 13*a* in the columnar portion 13.

However, because the spherical-surface-portion side flange 14 protrudes radially outward and a concavity is formed in the boundary area between the above-described columnar portion 13 and the spherical-surface-portion side flange 14, it is possible to accommodate a lubricating oil and foreign matter in the concavity although the volume of the accommodated lubricating oil and foreign matter is not so large as with the constricted portion 15 of the first embodiment.

In the case of the shoe 5 of this embodiment, a concavity is formed also in the boundary area between the above-described end-surface-portion side flange 16 and the columnar portion 13. Therefore, it is possible to accommodate a lubricating oil and foreign matter in the concavity, with the result that the lubricating oil is caused to flow beyond the end-surface-portion side flange 16 and flow between the end surface portion 12 and the swash plate 3, and that it is ensured that the foreign matter is prevented from entering between the end surface portion 12 and the swash plate 3.

For the concavity formed between the above-described spherical-surface-portion side flange 14 and the columnar portion 13 and the concavity formed in the boundary area between the end-surface-portion side flange 16 and the columnar portion 13, the forming radius may be changed. For example, when the forming radius is reduced, it is possible to accommodate a lubricating oil and foreign matter in volumes larger than before.

Figure 4:
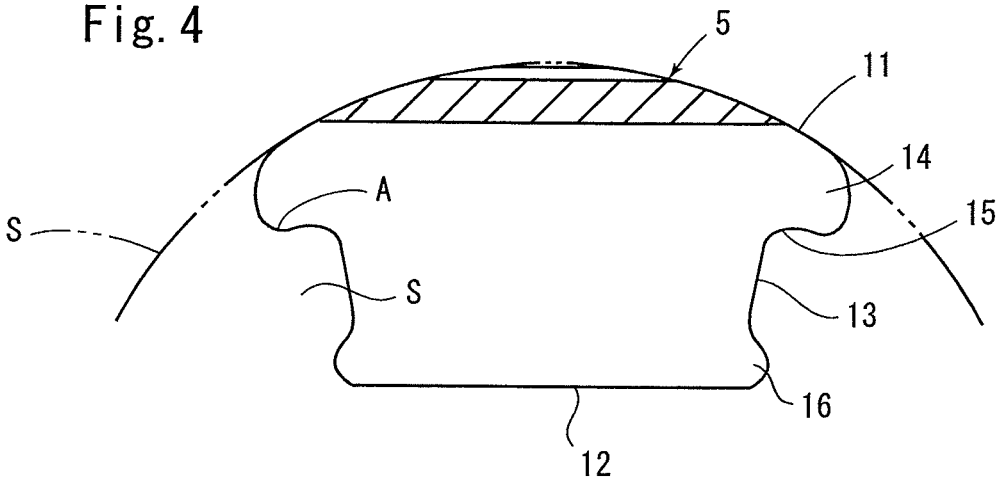
FIG. 4 is an enlarged sectional view of a shoe in the third embodiment.

The shoe 5 of the third embodiment shown in FIG. 4 is a combination of the component elements of the shoe 5 of the first and second embodiments described above. Specifically, in the shoe 5 of the second embodiment, the constricted portion 15 of the shoe 5 in the first embodiment is formed in the boundary area between the above-described spherical-surface-portion side flange 14 and the columnar portion 13.

According to the shoe 5 of the third embodiment described above, by forming the above-described constricted portion 15, it becomes possible to accommodate a lubricating oil and foreign substance in volumes larger than in the second embodiment described above.

The shoe 5 of the fourth embodiment shown in FIG. 5 is configured in such a manner that the end-surface-portion side flange 16 is extended more radially outward than in the shoe 5 of the third embodiment described above.

According to the shoe 5 of the fourth embodiment described above, a lubricating oil and foreign substance can be accommodated in a concavity formed in the boundary area between the columnar portion 13 and the end-surface-portion side flange 16 in volumes larger than in the third embodiment described above and, therefore, it is possible to prevent damage to the end surface portion 12 and the swash plate 3 by the foreign matter.

Figure 6:
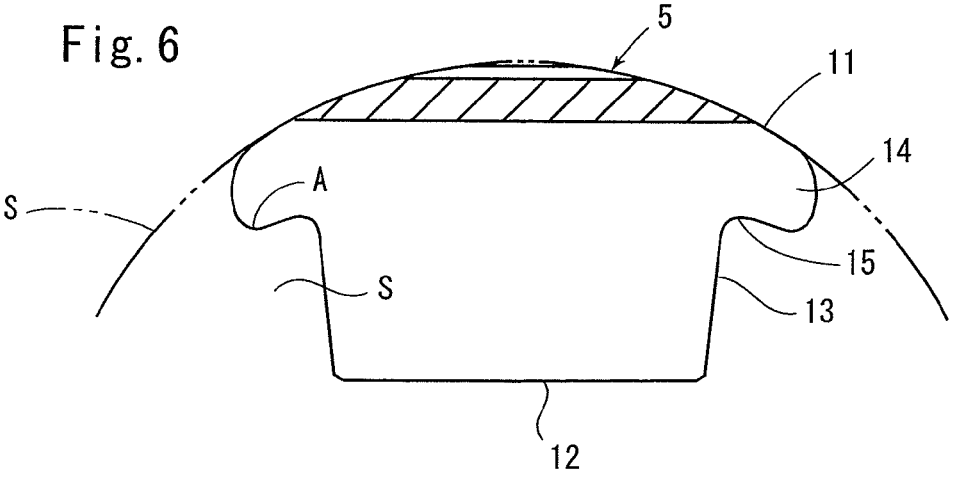
FIG. 6 is an enlarged sectional view of a shoe in the fifth embodiment.

Compared to the shoe 5 of the third embodiment, the shoe 5 of the fifth embodiment shown in FIG. 6 has a configuration in which the swash plate 3 side flange is omitted.

According to the shoe 5 of the fifth embodiment described above, it is possible to make the volume of the above-described space s larger than in the shoe 5 of the third embodiment described above and this enables a weight reduction of the shoe 5 to be accomplished.

The first to fifth embodiments described above are illustrative only, and it is also possible to use a shoe 5 in which the above-described embodiments are appropriately combined. For example, the swollen portion 13*a* of the first embodiment may be formed in the columnar portion 13 of the shoe 5 of the fifth embodiment described above.

REFERENCE SIGNS LIST

1 Swash plate compressor
3 Swash plate
4 Piston
4*a* Sliding surface
5 Shoe
11 Spherical surface portion
12 End surface portion
13 Columnar portion
14 Spherical-surface-portion side flange
15 Constricted portion
16 End-surface-portion side flange

The invention claimed is:

1. A swash plate compressor, comprising:

a swash plate which rotates around a rotary shaft;

a piston which moves forward and backward in response to the rotation of the swash plate and in which a hemispherical concave sliding surface is formed; and a shoe in which there are formed a flat end surface portion which comes into sliding contact with the swash plate and a spherical surface portion which comes into sliding contact with the sliding surface of the piston, wherein a columnar portion is formed between the spherical surface portion and the end surface portion in the shoe, and in a boundary area between the columnar portion and the spherical surface portion, there is formed a spherical-surface-portion side flange which protrudes radially outward and constitutes the spherical surface portion and an outer circumferential surface of the columnar portion is such that an intermediate area between the spherical surface portion and the end surface portion is formed as a swollen portion which swells radially outward.

2. A swash plate compressor, comprising:

a swash plate which rotates around a rotary shaft;

a piston which moves forward and backward in response to the rotation of the swash plate and in which a hemispherical concave sliding surface is formed; and a shoe in which there are formed a flat end surface portion which comes into sliding contact with the swash plate and a spherical surface portion which comes into sliding contact with the sliding surface of the piston, wherein a columnar portion is formed between the spherical surface portion and the end surface portion in the shoe, and in a boundary area between the columnar portion and the spherical surface portion, there is formed a spherical-surface-portion side flange which protrudes radially outward and constitutes the spherical surface portion and in a boundary area between the end surface portion and the columnar portion, there is formed an end-surface-portion side flange which protrudes radially outward and comes into sliding contact with the swash plate.

3. The swash plate compressor according to claim 2, wherein in a boundary area between the spherical-surface-portion side flange and the columnar portion, there is formed a constricted portion which is recessed toward the piston.

4. The swash plate compressor according to claim 2, wherein the diameter of the boundary area of the columnar portion with the spherical surface portion is made larger than the diameter of the boundary area with the end surface portion.

5. The swash plate compressor according to claim 2, wherein the surface roughness of the columnar portion is made rougher than the surface roughness of the spherical surface portion and the end surface portion.

6. The swash plate compressor according to claim 2, wherein when the inclination of the shoe becomes a maximum with respect to a center axis, an end portion of the spherical-surface-portion side flange on the swash plate side is set in such a manner as not to protrude to the swash plate side beyond the height of a portion of the piston nearest to the swash plate.

7. The swash plate compressor according to claim 2, wherein a micro corrugated shape is formed on the sliding surface with the swash plate in the end.

* * * * *